United States Patent [19]

Dennis et al.

[11] 4,452,031

[45] Jun. 5, 1984

[54] AUTOMATIC CARD DISPENSER AND PICK-OFF ASSEMBLY

[75] Inventors: Edmund G. Dennis, Belle Terre; C. Edward Brandmaier, Centerport, both of N.Y.

[73] Assignee: Cashin Systems Corp., Hauppauge, N.Y.

[21] Appl. No.: 367,780

[22] Filed: Apr. 12, 1982

Related U.S. Application Data

[63] Continuation-in-part of Ser. No. 143,529, Apr. 24, 1980, Pat. No. 4,328,657.

[51] Int. Cl.[3] ..... B65B 25/06; B65B 49/16

[52] U.S. Cl. ..... 53/586; 53/231; 53/389; 53/DIG. 1; 414/128; 493/125

[58] Field of Search ..... 53/DIG. 1, 466, 251, 53/250, 231, 228, 206, 586, 580, 593, 377, 389; 414/128, 125; 493/125, 124, 123

[56] References Cited

U.S. PATENT DOCUMENTS

| | | | |
|---|---|---|---|
| 1,962,872 | 6/1934 | Moon | 414/125 X |
| 2,235,377 | 3/1941 | Laxo | 414/128 X |
| 2,764,070 | 9/1956 | Fay et al. | 493/125 |
| 2,907,152 | 10/1959 | Hensgen et al. | 53/DIG. 1 |
| 3,405,504 | 10/1968 | Marshall et al. | 53/74 |
| 3,618,482 | 11/1971 | Bowman | 493/123 |
| 3,815,319 | 6/1974 | Vedvik | 53/DIG. 1 X |
| 4,287,016 | 9/1981 | Kerwin et al. | 414/128 X |

FOREIGN PATENT DOCUMENTS

| | | | |
|---|---|---|---|
| 102563 | 9/1965 | Denmark | 414/125 |

*Primary Examiner*—James F. Coan

*Attorney, Agent, or Firm*—Kane, Dalsimer, Kane, Sullivan and Kurucz

[57] ABSTRACT

A cardboard sheet dispenser is incorporated in a bacon slicing machine line that is operable to group slices in shingled fashion and into segregated batches of predetermined weight. The dispenser directs a cardboard sheet in synchronization with the movement of the batches so that individual batches are placed on a sheet and thereafter transferred to subsequent packaging stations. The dispenser includes a hopper for receiving vertically stacked cardboard sheets and includes a base having a plurality of strippers serving to support the stack of sheets while assuring that only one sheet at a time is removed from the hopper. A pick-off assembly operates to remove the lowermost sheet from the hopper and transfer it to the nip of a roller assembly. The pick-off assembly includes a first piston-cylinder assembly that assumes a vertical position below the hopper so that suction cups at the free end of the piston of this assembly is adapted to engage and secure the lowermost sheet in the hopper upon extension of this piston and upon retraction thereof lower this sheet to a lowered position. A second piston-cylinder assembly is rigidly connected to the first piston-cylinder assembly and is adapted to be actuated between a retracted position at which both piston-cylinder assemblies are in the vertical position and an extended position. A cam follower bar extending laterally from the free end of the piston of the second piston-cylinder assembly travels in a pair of complementary cam slots such that when the piston of the second piston-cylinder assembly is extended, the cam follower bar follows the slots to cause the piston-cylinder assemblies to assume a tilted position.

7 Claims, 10 Drawing Figures

AUTOMATIC CARD DISPENSER AND PICK-OFF ASSEMBLY

REFERENCE TO RELATED APPLICATIONS

This application is a continuation-in-part of U.S. patent application Ser. No. 143,529 filed Apr. 24, 1980 now U.S. Pat. No. 4,328,657.

BACKGROUND OF THE INVENTION

In our earlier above-referenced patent application, a cardboard sheet dispenser is disclosed and is incorporated in a bacon or other pork product slicing machine line that is operable to group slices in shingled fashion and into segregated batches of predetermined weight. The dispenser directs a cardboard sheet in synchronization with the movement of the batches so that individual batches are placed on a sheet and thereafter transferred to subsequent packaging stations. The dispenser includes a hopper for receiving vertically stacked cardboard sheets and is provided with a plurality of restrainers that cooperate in supporting the stack of sheets and at the same time fan the sheets to minimize sticking of the sheets one to the other. The base of the hopper includes a plurality of strippers also serving to support the stack of sheets and assures that only one sheet is removed from the base of the hopper at a time. A pick-off assembly including a pivotal piston-cylinder assembly operates to remove the lowermost sheet from the hopper and transfer the lowered sheet into the nip of a roller assembly. A second piston-cylinder assembly coupled with the first piston-cylinder assembly actuates the first assembly between a vertically upright position and an inclined position at which the sheet is picked up by the lower assembly. The roller assembly directs the cardboard sheet to a location of which it is adapted to be moved by a pusher assembly to a location where the sheet receives a batch of slices thereon. The cardboard sheet feeding cycle is commenced upon the retraction of this pusher assembly.

SUMMARY OF THE INVENTION

The present application is directed to an improvement in the pick-off assembly of our earlier cardboard sheet dispenser and has as its principal objective to provide a more positive and reliable transfer of a cardboard sheet from a hopper to a roller assembly.

Other objects and advantages will become apparent from the following detailed description which is to be taken in conjunction with the accompany drawings.

DETAILED DESCRIPTION OF THE PREFERRED EMBODIMENT

Figure 1:
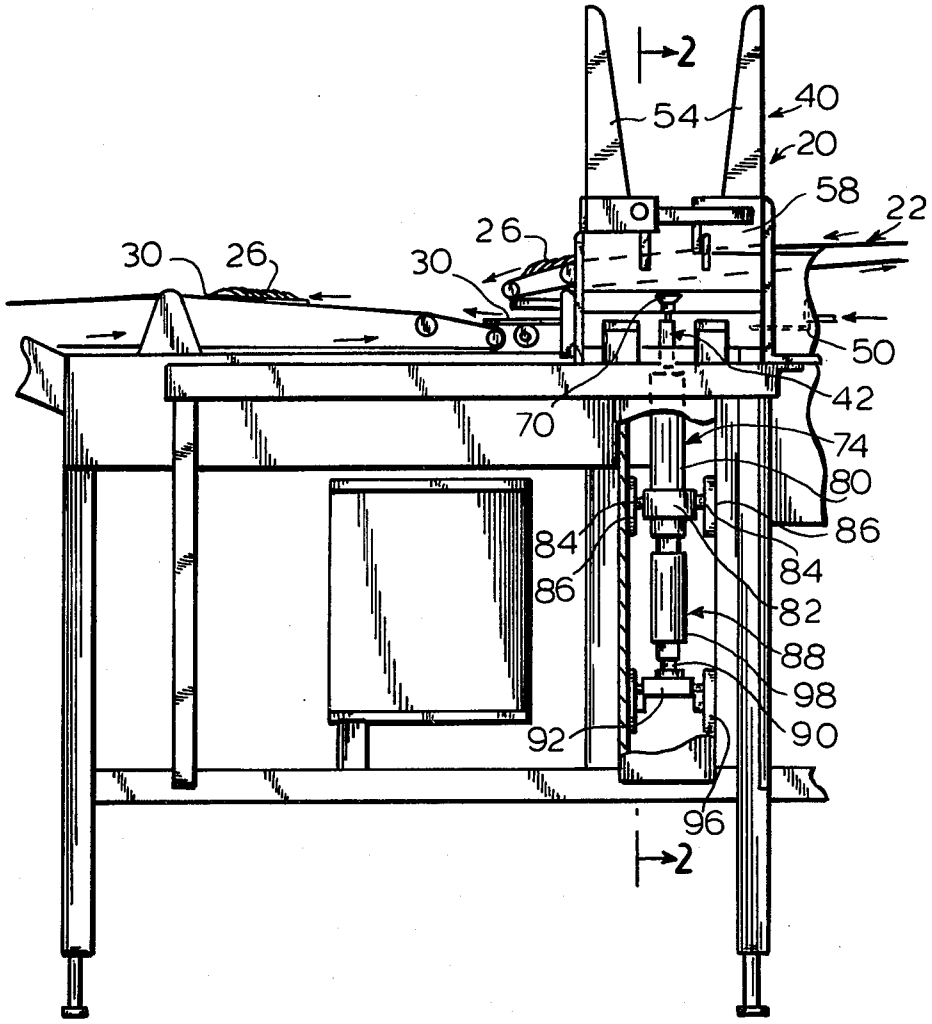
FIG. 1 is a schematic side elevational view of an automatic cardboard sheet dispenser incorporating the teachings of this invention associated with a bacon slicing line shown fragmentarily in which segregated batches of sliced product are placed on the dispensed cardboard sheet and conveyed to subsequent stations to complete the packaging of the product.

In the drawings, a cardboard sheet dispenser 20 is shown associated with a conveying system 22 leading from the discharge end of a slicing and measuring station (not shown). At this station bacon or bacon simulating pork product or for that matter any other food product is sliced and segregated into batches 26 of shingled slices having a predetermined weight or measure. The conveying system 22 connects with the leading end of a packaging station (not shown) for completing the packaging of the batches 26. The cardboard sheet dispenser 20 operates to associate a cardboard sheet 30 at the proper time, in a timed and controlled manner with the segregated batch 26 of slices.

With specific reference to the details of the cardboard sheet dispenser 20, a cardboard sheet hopper 40 receives a plurality of stacked cardboard sheets 30, the lower cardboard sheet of which is adapted to be removed by a pick-off assembly 42 and transferred by this assembly to a nipper feed roll assembly 46. This nipper roll assembly 46, in turn, places a cardboard sheet 30 against an adjustable stop plate 48 where this cardboard sheet 30, at the proper time, is adapted to be transferred by the pusher assembly 50 to another location at which this sheet receives thereon a batch 26 of the sliced product.

Referring to the hopper 40, four corner brackets 54 are supported vertically by a base frame 58. At the base of the hopper 40 appear a plurality of strippers 68 which cooperate in supporting the stack of cardboard sheets 30 and in the separation of cardboard sheets while providing assurance that only one cardboard sheet 30 at a time will be removed from the lower end of the hopper 40.

Figure 8:
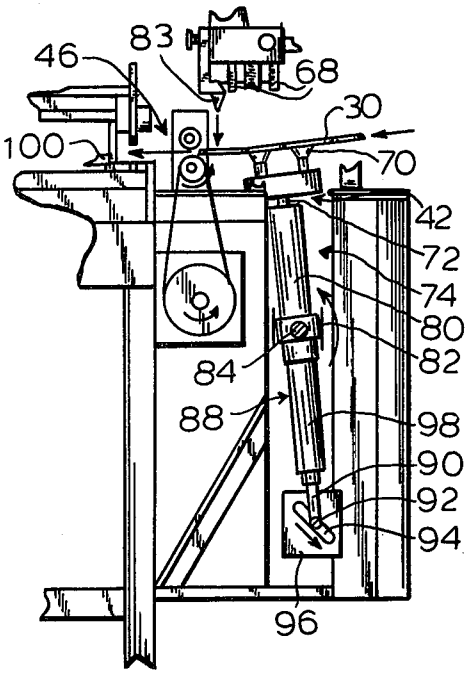
FIG. 8 is a view similar to FIG. 7 with the pick-off suction cups tilted to place the supported cardboard sheet in the nip of rollers which are to transfer the supported cardboard sheet to a station at which the cardboard sheet may be transferred longitudinally into further position at which it is capable of receiving the segregated batch of sliced bacon.
Figure 9:
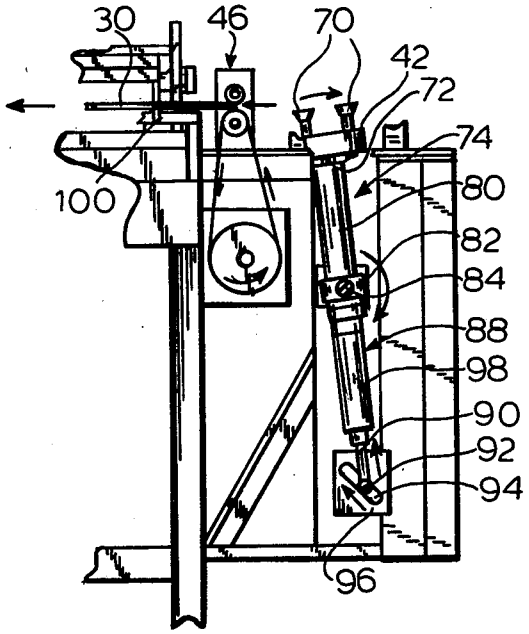
FIG. 9 is a view similar to FIG. 8 with the pick-off suction cups tilted but in the process of being returned to their vertical upright position and with the cardboard sheet being transferred by the nipper rollers.

Reference is now made to the pick-off assembly 42 which includes a number of suction cups 70 supported by the piston 72 of the piston-cylinder pick-off assembly 74. The cylinder 80 of the piston-cylinder pick-off 74 has mounted thereon a bracket 82 from which extends pivot bars 84 journaled in bearings 86. This pivotal movement permits the piston-cylinder pick-off assembly 74 to pivot or tilt from a vertically extending position as shown in FIGS. 2, 3, 4, 5, 7 and 10 to an inclined or tilted position as shown in FIGS. 8 and 9. This pivotal movement is obtained as a result of the actuation of piston-cylinder cam assembly 88, the piston 90 of which has connected therewith laterally extending cam bar 92 operating as a cam follower within the cam slot 94 provided in a mount 96. The base of the cylinder 80 of the piston-cylinder pick-off assembly 74 is rigidly connected with the base of the cylinder 98 of the piston-cylinder cam assembly 88 so that these interconnected piston-cylinder assemblies 74 and 88 will tilt together upon the actuation of the piston-cylinder assembly 88. In this connection, when the piston 90 is retracted in the cylinder 98 of the piston-cylinder assembly 88, both of the interconnected piston-cylinder assemblies 74 and 88 will be vertical. When the piston 82 is extended a predetermined amount, the cam follower bar 92 will travel in slot 94 of both mounts 96 thereby causing both piston-cylinder assemblies 74 and 88 to be tilted about the pivot bar 84 journaled in bearings 86 to the inclined position of FIG. 8. In this position, the cardboard sheet 30 held by the suction cups 70 will be placed into the nip of the nipper roller assembly 46.

Figure 2:
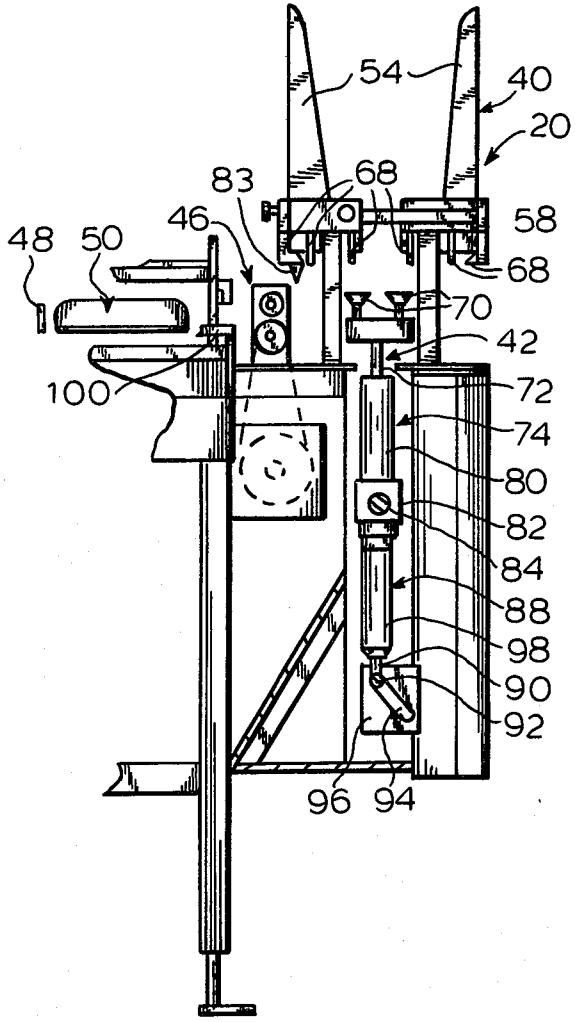
FIG. 2 is a sectional view taken along the lines 2—2 of FIG. 1 showing the details of the cardboard sheet pick-off assembly with the cardboard sheet pick-off suction cups in a lowered position at the start of the cardboard sheet pick-off operational sequence.
Figure 3:
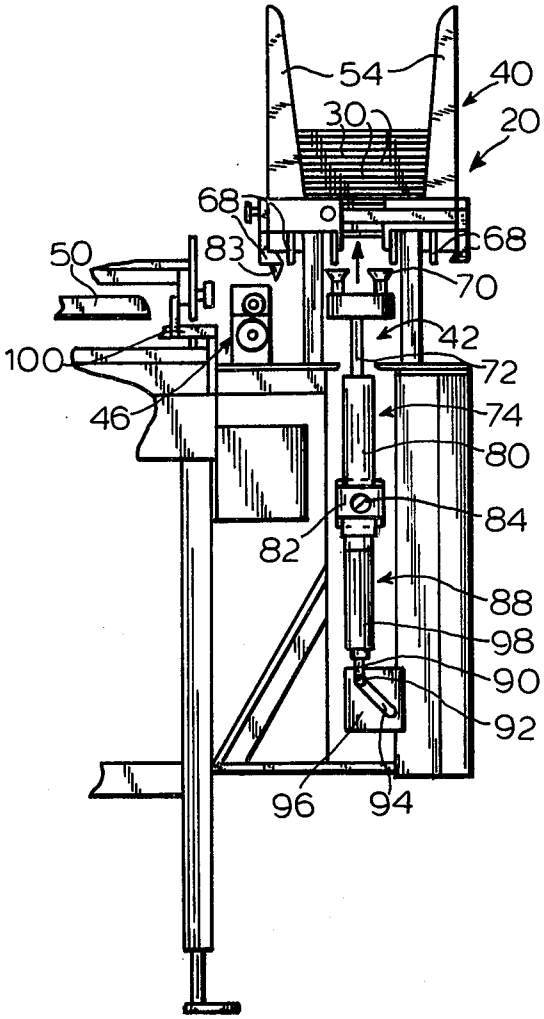
FIG. 3 is a view similar to FIG. 2 with the pick-off suction cups in the process of being elevated or raised.
Figure 4:
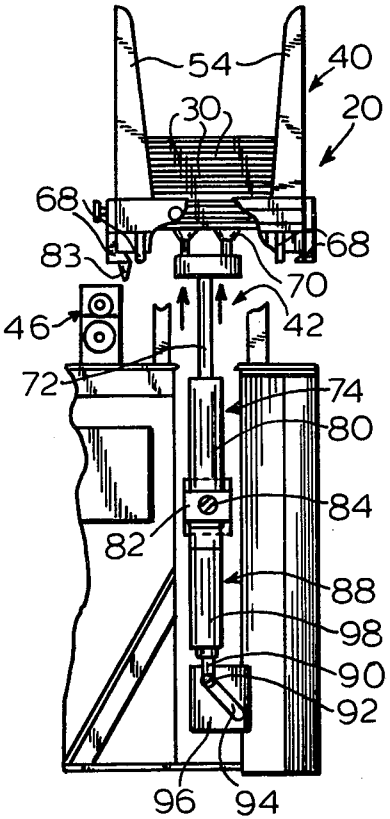
FIG. 4 is a view similar to FIG. 3 with the cardboard sheet pick-off suction cups in their fully raised position at which the lowermost cardboard sheet in the hopper is engaged and about to be lowered.
Figure 5:
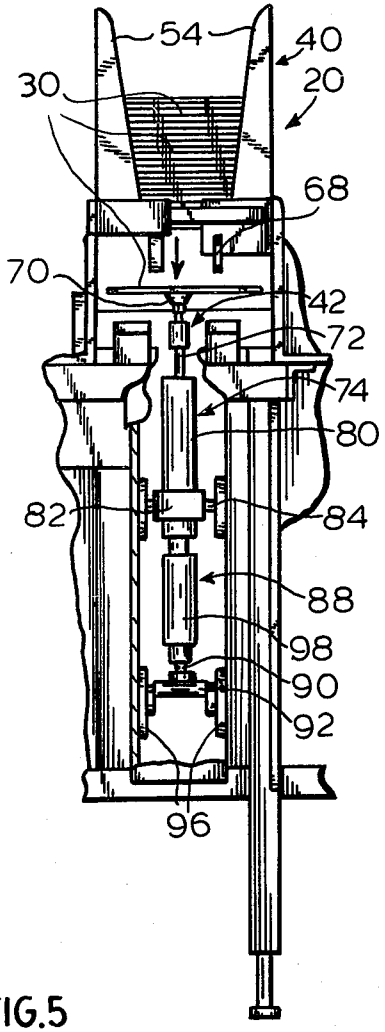
FIG. 5 is a view of the pick-off assembly similar to that of FIG. 1 with the cardboard sheet pick-off suction cups lowered with a cardboard sheet thereon.
Figure 6:
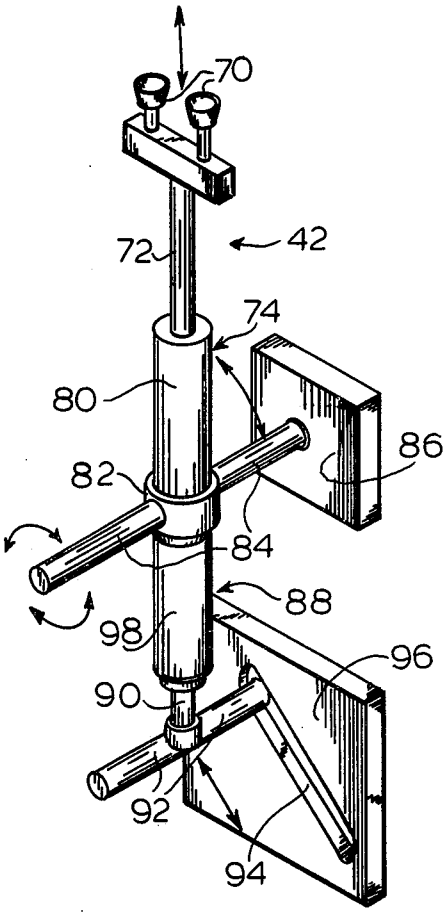
FIG. 6 is a somewhat enlarged perspective view of the interconnected piston-cylinder assemblies.
Figure 7:
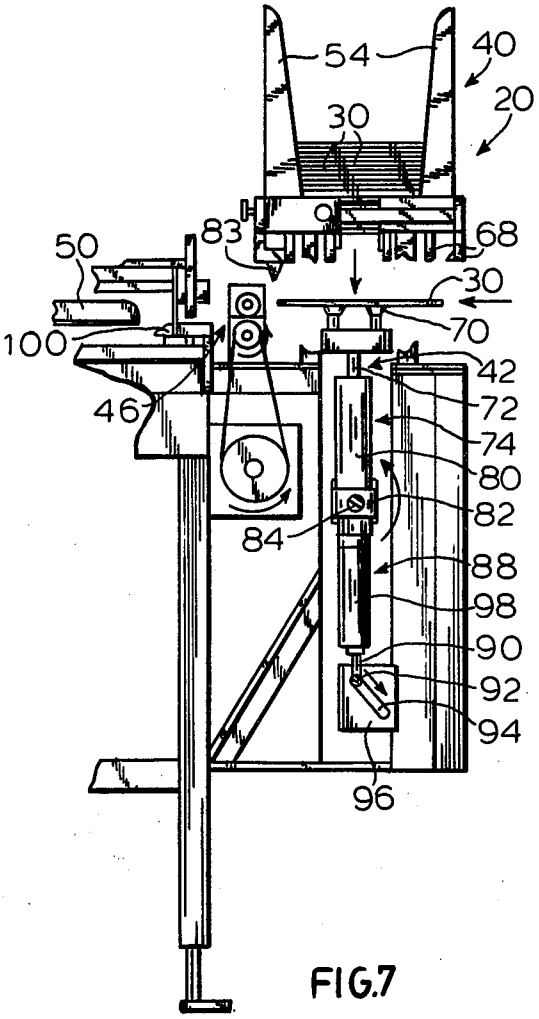
FIG. 7 is a view similar to FIG. 4 with the cardboard sheet pick-off suction cups and a cardboard sheet thereon in a lowered position prior to being tilted.
Figure 10:
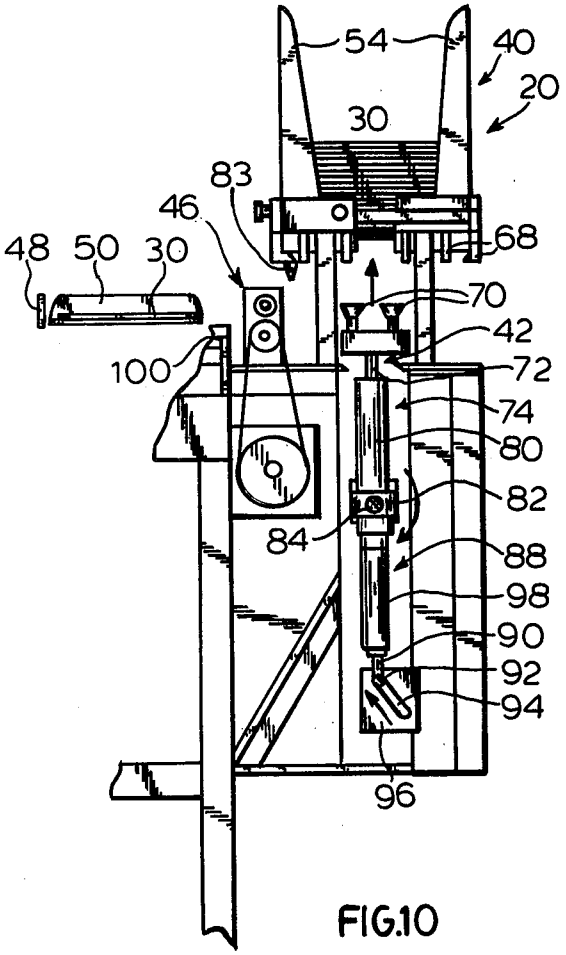
FIG. 10 is a view similar to FIG. 9 with the pick-off suction cups in their initial position fully retracted and in an upright position prior to being raised to engage and pick-off the next lowermost cardboard sheet.

At the start of the sequence of operation, the interconnected piston-cylinder assembly 74 and 88 will be vertically disposed and their respective pistons 72 and 90 will be retracted (see FIGS. 1, 2 and 10). The piston-cylinder assembly 74 will initially be actuated (FIG. 3) to extend its piston rod 72 vertically so that cups 70 engage with the lowermost cardboard sheet 30 in the hopper 40 (FIG. 4). The suction within the cups 70 will cause the cups 70 to secure with the lowermost cardboard sheet 30 so that when the piston 72 is retracted (FIG. 5) within cylinder 80, the lowermost cardboard sheet will be withdrawn below the strippers 68 to the lowermost position shown in FIG. 7. Thereafter, the piston-cylinder assembly 88 will be actuated to extend piston 90 causing cam follower bar 82 to follow the cam slot 94 thereby tilting both of the piston-cylinder assemblies 74 and 88 (FIG. 8) to the fully tilted position shown in FIG. 9 at which the lowered cardboard sheet 30 will be placed into the nip of the nipper roll assembly 46.

The nipper roll assembly 46 will receive the lowered cardboard sheet 30 and with this occurs the suction in the cup 70 to be momentarily relieved to cause disengagement of the cup 70 with the cardboard sheet 30 transferred to the nipper roll assembly 46. Thereafter the piston 90 will retract to cause the cam follower bar 92 to follow the slot 94 thereby causing the piston-cylinder assemblies 74 and 88 to assume their vertical position (see FIGS. 1, 2 and 10). The suction for the cups 70 will be reapplied to enable these cups to firmly secure with the lowermost card sheet 30 in the hopper 40 when the next cardboard dispensing cycle is initiated.

When the cardboard sheet 30 is transferred to the nipper assembly 46, it will be initially placed on the platform 100; and as a result of the cooperation of the light air jet or blast from the nozzle 83, the sheet 30 will be properly placed between the nip of the roller assembly 46 and not fly away when the suction of the cups 70 is deactivated. When the cardboard sheet 30 is placed in the nipper roller assembly 46, it will be transferred onto the platform 100 against the stop 48. The cardboard sheet 30 will remain in this position until it is moved as a result of the reciprocation of pusher assembly 50 to a position at which it receives in a synchronized manner, a batch 26 of sliced food product travelling on the conveyor system 22.

Thus, the several aforenoted objects and advantages are most effectively attained although several somewhat preferred embodiments of the invention have been disclosed and described in detail herein, it should be understood that this invention is in no sense limited thereby and its scope is to be determined by that of the appended claims.

What is claimed is:

1. A cardboard sheet dispenser for use on a food product slicing machine line that groups the slices into segregated batches of predetermined measure, the dispenser being operable to dispense a sheet of cardboard from a storage area to a first location at which a batch of the slices are placed thereon, the cardboard sheet dispenser comprising:

a hopper for containing a plurality of vertically stacked cardboard sheets, the hopper including a base and a plurality of strippers at the base for cooperating in supporting the stack and cooperating in separating the cardboard sheets at the base to assure against sticking of the cardboard sheets to one another while permitting only one cardboard sheet at a time to be removed from the base of the hopper;

a pick-off assembly for removing the lowermost cardboard sheet from the hopper and transferring it to a second location, the pick-off assembly including a first piston-cylinder assembly assuming a normal vertically disposed position below the hopper and the first piston-cylinder assembly having at least one suction cup at the free end of the piston, the piston adapted to be actuated between a retracted position away from the base of the hopper and an extended position at which the suction cup is adapted to be placed into engagement with and secure by suction the lowermost cardboard sheet in the hopper, upon retraction of the piston, the lowermost cardboard sheet secured by the cup is adapted to be lowered to a lowered position, a second piston-cylinder assembly rigidly connected with and secured to the first piston-cylinder assembly, the piston of the second piston-cylinder assembly adapted to be actuated between a retraction position at which both piston-cylinder assemblies are adapted to assume a normal vertically disposed position and an extended position, camming means for tilting the piston-cylinder assemblies from a normally disposed vertical position to a tilted position when the piston of the second piston-cylinder assembly is in an extended position; and conveying means for conveying the sheet at the second location to the first location at a predetermined time to permit the batch to be placed thereon.

2. The invention in accordance with claim 1, wherein the camming means includes a cam follower bar extending laterally from the free end of the piston of the second piston-cylinder assembly, at least one cam slot receiving the cam follower bar and being so constructed and arranged that when the piston of the second piston-cylinder assembly is in a retracted position the piston-cylinder assemblies are disposed in their more vertically disposed position and when this piston is extended the cam follower bar follows the slot to cause the piston-cylinder assembies to tilt, pivot means coupled with one of the piston-cylinder assemblies permitting the piston-cylinder assemblies to tilt from a normally disposed vertical position to a tilted position.

3. The invention in accordance with claim 2, wherein a supporting bracket is provided, and the pivot means extends between the cylinder of the first piston-cylinder assembly and the supporting bracket.

4. The invention in accordance with claim 3, wherein a pair of complementary cam slots are on the supporting bracket and the cam follower bar extends into both slots.

5. The invention in accordance with claim 1, wherein a nipper roll assembly receives the lowered cardboard sheet from the suction cup when the piston-cylinder assemblies are in the tilted position.

6. The invention in accordance with claim 5, wherein the drive roller assembly includes a driven roll and a drive roll defining a nip therebetween, a platform at the entrance to the nip of the roller assembly for receiving a cardboard sheet thereon when the first assembly is in its inclined position and means for momentarily deactivating the suction in the cup when the cardboard sheet is placed on the platform.

7. The invention in accordance with claim 6, wherein an air jet means directs a jet of air downwardly upon the cardboard sheet placed on the platform to prevent the cardboard sheet from flying and assure that it is placed in the nip of the roller assembly.

* * * * *